US005313923A

United States Patent [19]

Takeuchi et al.

[11] Patent Number: 5,313,923

[45] Date of Patent: May 24, 1994

[54] CONTROL APPARATUS FOR FUEL PUMP

[75] Inventors: Shigeru Takeuchi, Gamagori; Junji Sugiura; Katsunori Michiyama, both of Toyota, all of Japan

[73] Assignee: Nippondenso Co., Ltd., Kariya, Japan

[21] Appl. No.: 871,224

[22] Filed: Apr. 20, 1992

[30] Foreign Application Priority Data

Apr. 24, 1991 [JP] Japan ..... 3-094441

[51] Int. Cl.[5] ..... F02M 37/04

[52] U.S. Cl. ..... 123/497; 123/198 DB

[58] Field of Search ..... 123/497, 499, 198 DB, 123/198 D

[56] References Cited

U.S. PATENT DOCUMENTS

| | | | |
|---|---|---|---|
| 3,750,635 | 8/1973 | Hoffman | 123/497 |
| 3,817,225 | 6/1974 | Priegel | 123/497 |
| 3,973,539 | 8/1976 | Jones | 123/497 |
| 4,048,964 | 9/1977 | Kissel | 123/497 |
| 4,192,279 | 3/1980 | Maisch | 123/198 DB |
| 4,359,984 | 11/1982 | Nakao | 123/497 |
| 4,577,604 | 3/1986 | Hara | 128/497 |
| 4,932,387 | 6/1990 | Flam | 123/497 |
| 4,971,001 | 11/1990 | Tharman | 123/198 D |
| 5,092,302 | 3/1992 | Mohan | 123/497 |

FOREIGN PATENT DOCUMENTS

| | | | |
|---|---|---|---|
| 2250629 | 4/1973 | Fed. Rep. of Germany | 123/497 |
| 0179359 | 11/1982 | Japan | 123/497 |
| 0038366 | 3/1983 | Japan | 123/497 |
| 0048767 | 3/1983 | Japan | 123/497 |
| 0235658 | 9/1988 | Japan | 123/497 |
| 1255497 | 10/1989 | Japan . | |
| 360214 | 3/1991 | Japan . | |

*Primary Examiner*—Carl S. Miller

*Attorney, Agent, or Firm*—Cushman, Darby & Cushman

[57] ABSTRACT

A pump control apparatus is disclosed which is of a small size, quietly operates and has a small number of signal output lines without loosing the fuel pump stopping function upon engine stall. This control apparatus of the invention includes a computer 5 which provides a signal output line 9 with an off-signal that is equal to the potential of a body 7 of a vehicle upon engine stop, and which provides the signal output line 9 with a drive signal that is higher in potential than the off-signal upon engine operation. This control apparatus further includes an FET 12 which is connected in series with a power supply line 8 and a fuel pump 4 and which, when receiving the drive signal, changes the terminal voltage of the fuel pump 4 in accordance with the input drive signal, and when receiving a voltage corresponding to the off-signal, stops the fuel pump 4. Thus, according to this invention, even if the power supply line 8 and the signal output line 9 are brought to the ground potential, or grounded, the fuel pump 4 is sure to be stopped, and thus the safety can be achieved.

6 Claims, 10 Drawing Sheets

MEASURED CURRENT VALUE UPON PUMP LOCK

CONTROL APPARATUS FOR FUEL PUMP

BACKGROUND OF THE INVENTION

1. Field of the Invention

This invention relates to a control apparatus for a fuel pump, and particularly to a control apparatus having a function to control a pump for supplying fuel to an engine of a vehicle.

2. Description of the Related Arts

As shown in FIG. 10 for example, there is known a control apparatus 100 for a fuel pump 101 which has a power switching function for controlling fuel flow to an engine of a vehicle by changing the terminal voltage of the fuel pump 101 under a controller 103 which includes an FET (field effect transistor) 102 connected to the ground side of the fuel pump 101, and a pump stop function for surely stopping fuel supply to the engine by turning off a relay 105 which is connected in series with a power supply line 104 of the fuel pump 101 upon engine stopping.

Both the controller 103 and the relay 105 are controlled by a control signal transmitted from a computer 106 on the basis of the information of the vehicle's driving condition such as a throttle opening signal or vehicle speed signal, or only the relay 105 is controlled by a control signal transmitted from an air flow meter (not shown) on the basis of air intake to the engine. In FIG. 10, there are also shown a battery 109, a main relay switch 110, an input discriminating circuit 111 and a driver 112 for the FET 102.

In addition, JP-A-1-255497 discloses another control apparatus for a fuel pump, which is an improvement of the control apparatus 100 by removing the relay 105 of noisy working sound from the controller 103 by which the fuel pump 101 is stopped upon engine stop, in order to reduce the size of the apparatus, simplify the signal output lines 107, 108 and quiet the apparatus.

In this prior art, however, when a connection wiring conductor 113 which connects the fuel pump 101 and the FET 102 is made in contact with the body or bitten thereinto, the wiring conductor 113 is grounded because the vehicle's body is generally grounded. Also, when the signal output line 107 is similarly made in contact with the body or bitten thereinto, the signal output line 107 is grounded.

The result of the above cases is that the computer 106, upon engine stop, cannot stop the fuel pump 101 even by transmitting the control signal for stopping the fuel pump 101.

JP-A-60214 discloses an apparatus for protecting a semiconductor device, in which the operating condition is detected through voltage of the FET element detected by a current mirror MOS (metal oxide semiconductor) FET and the temperature of a power FET element is detected by detecting the forward voltage of the diode thermally connected to the power FET. This apparatus, however, merely detects the abnormal condition of the semiconductor device and protects the semiconductor device.

Therefore, the semiconductor device cannot be controlled so that the abnormal condition can be removed in accordance with the characteristic of the load which is controlled by the semiconductor device.

SUMMARY OF THE INVENTION

It is an object of the invention to provide a control apparatus for a fuel pump which is capable of achieving miniaturization, simplification of signal output lines and quietness without loosing the pump stop function upon engine stop.

It is another object of the invention to provide a fuel-pump control apparatus having a diagnosis function for protecting the drive controller 103 when the fuel pump is abnormal, and informing the computer 106 of the abnormal condition.

According to this invention, there is provided a fuel-pump control apparatus having a battery of which one electrode is connected to the body of a vehicle, a fuel pump to which power is supplied from this battery, a computer for transmitting a stop signal equal to the potential of the body of the vehicle to the signal output line or transmitting a drive signal different in potential from this stop signal to the signal output line on the basis of the driving condition of the vehicle, and a semiconductor device connected in series with the power supply line of the fuel pump, connected to the signal output line so that when the drive signal is supplied through the signal output line to the semiconductor device, the semiconductor device controls the fuel pump to be supplied with current and that when the stop signal is supplied through the signal output line to the semiconductor device, the semiconductor device controls the fuel pump to be deenergized.

The fuel-pump control apparatus of the invention may further have at least one circuit from the group of a short detecting circuit for detecting a short circuit on the load side of the semiconductor device which controls to deenergize the fuel pump, and supplying a stop signal, an overcurrent detecting circuit for detecting overcurrent flowing through a semiconductor device and supplying a signal for turning the semiconductor device on, and a temperature detecting circuit for detecting the temperature of the semiconductor device and supplying a signal for turning the semiconductor device on.

According to the invention, when the computer supplies the drive signal different in potential from the stop signal to the signal output line on the basis of the driving condition of the vehicle, the semiconductor device turns the fuel pump on so that the fuel is supplied to the engine. On the contrary, when the computer supplies the stop signal equal to the potential to that of the body of the vehicle to the signal output line o the basis of the driving condition of the vehicle, the semiconductor device turns the fuel pump off so that the fuel supply to the engine stops.

Even if either one of the power supply line and the signal output line is made in contact with the body of the vehicle or bitten thereinto so as to be grounded, the computer transmits the stop signal which is equal to the potential of the body of the vehicle, thus surely stopping the fuel pump.

In addition, the signal output line through which the drive signal is supplied from the computer to the semiconductor device is integral with the signal output line through which the stop signal is transmitted, and no relay is used. This makes it possible to make the apparatus small, simplify the signal output lines and quiet the apparatus.

Moreover, according to the invention, when a trouble occurs in the power supply wiring to the fuel pump or in the drive circuit, causing the load to be short-circuited or the semiconductor device to be overheated, the computer is informed of this trouble and thus it can control the operation of the fuel pump. Also, when the pump or the piping gets clogged by an obstacle, the obstacle may be removed automatically.

DESCRIPTION OF THE PREFERRED EMBODIMENTS

Figure 1:
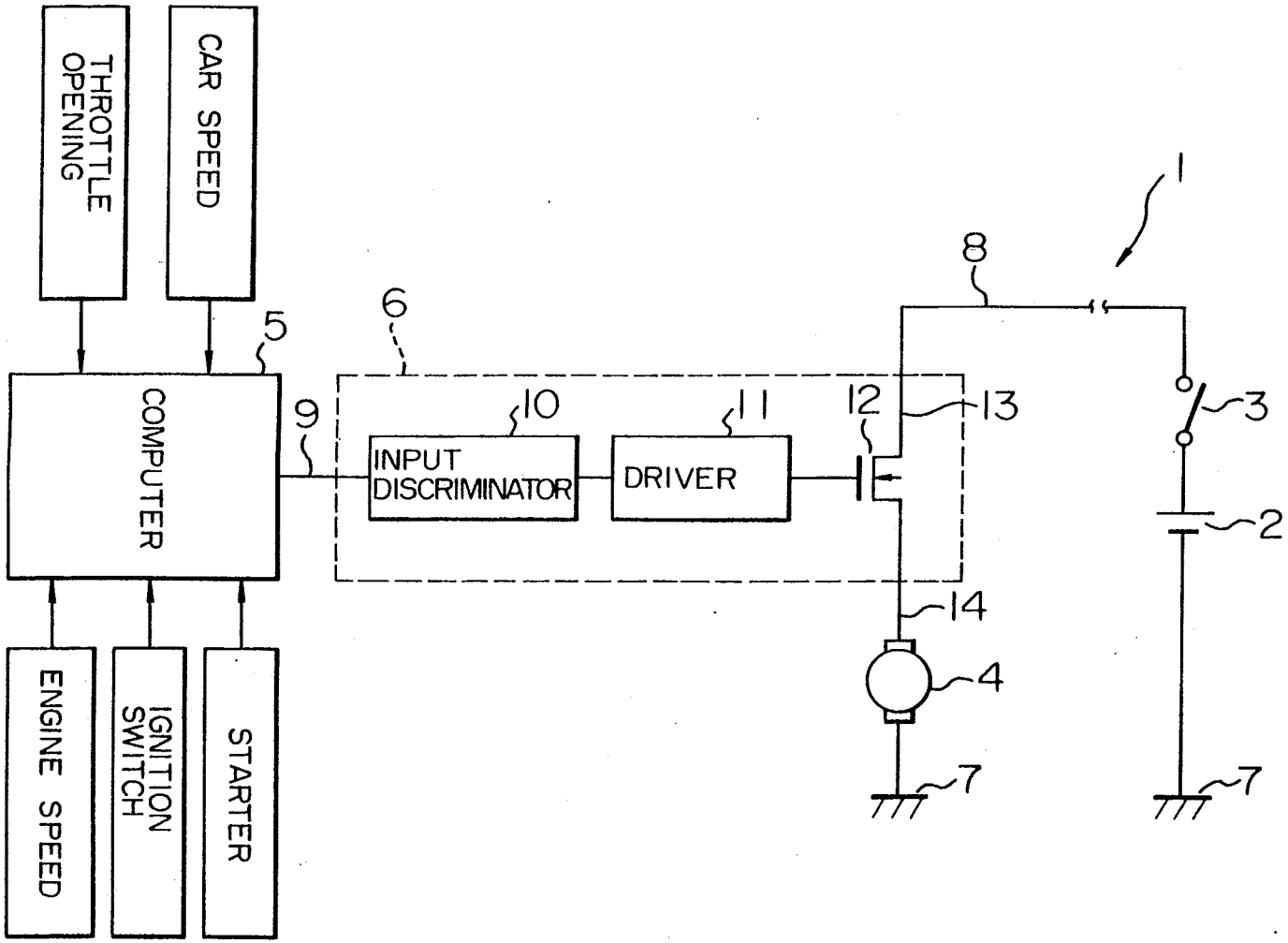
FIG. 1 is a schematic circuit diagram of a fuel-pump control apparatus for automobiles.
Figure 2:
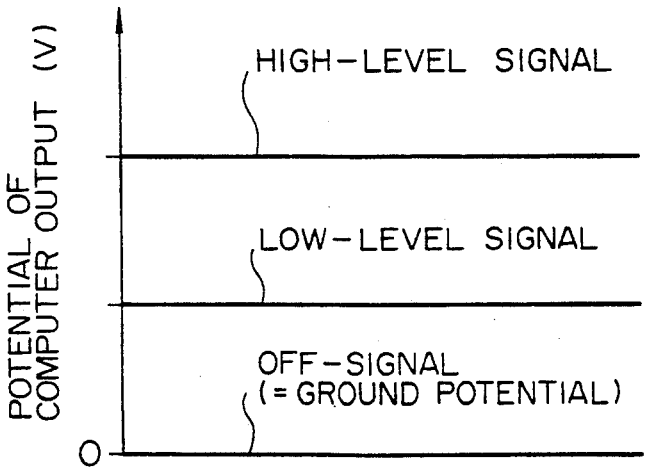
FIG. 2 is a graph of the potentials of the outputs from the computer.
Figure 3:
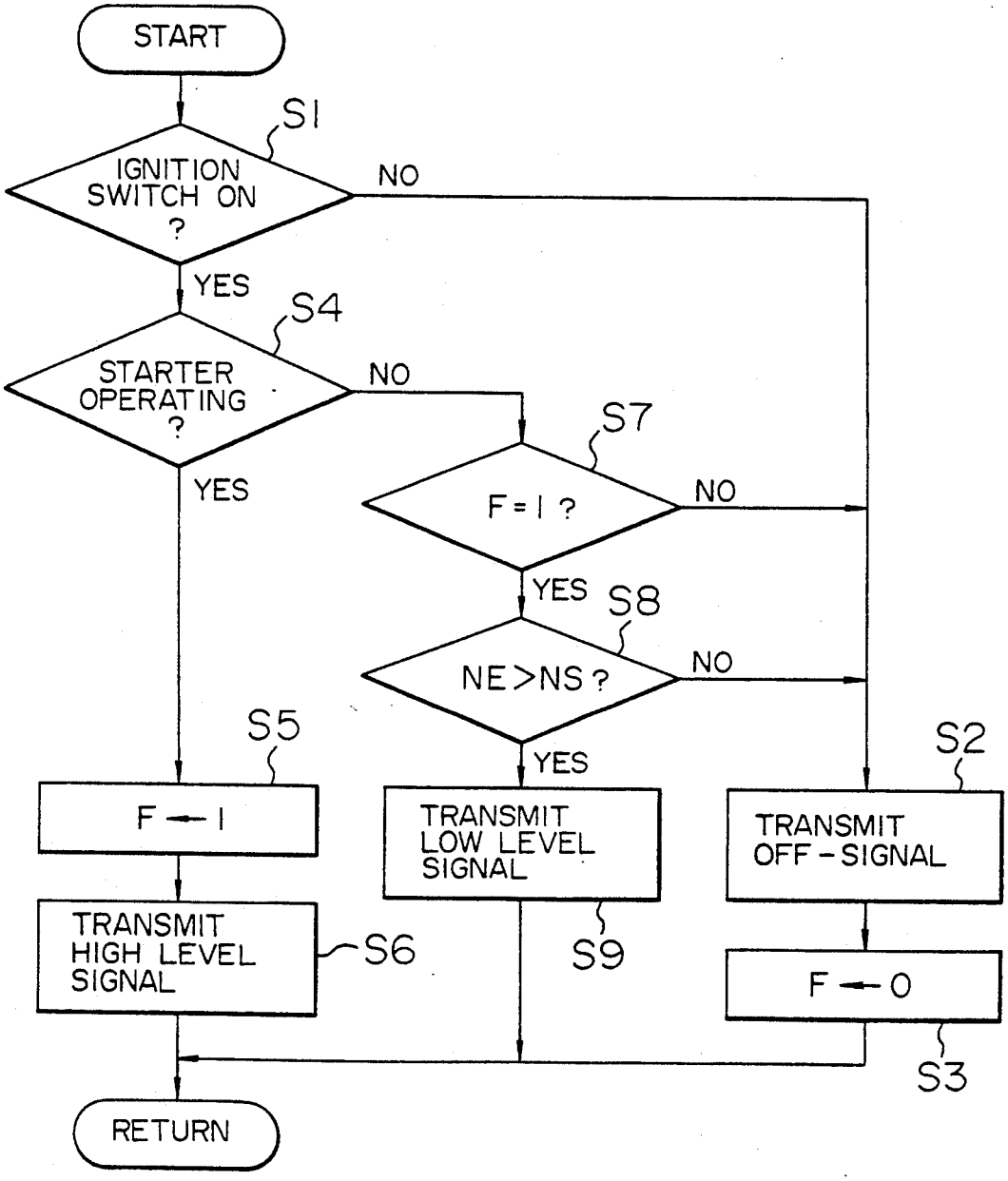
FIG. 3 is a flowchart of the operation of the computer.

One embodiment of a fuel-pump control apparatus of the invention will be described with reference to FIGS. 1 to 3. FIGS. 1 to 3 show a fuel-pump control apparatus 1 for automobiles.

The fuel-pump control apparatus 1 has a battery 2, a main relay switch 3, a fuel pump 4, a computer 5 and a drive controller 6.

The battery 2 supplies power to the fuel pump 4, and has a negative electrode connected to a body 7 of an automobile. The main relay switch 3 is closed when an ignition switch (not shown) connected in parallel therewith is closed to turn a relay coil (not shown) on. The fuel pump 4 has an electrode terminal connected to a positive electrode of the battery 2 through the main relay switch 3 and a power supply line 8, and it supplies pressurized fuel to the engine (not shown) when powered. The other electrode terminal of the fuel pump 4 is connected to the body. The power supply line 8 is formed of a set of wiring harness.

The computer 5 supplies a control signal to a signal output line 9 on the basis of the driving condition of the automobile such as a throttle opening signal, a car speed signal, an engine revolution rate signal, an on-off signal to the ignition switch and an operating signal for a starter. The control signal, as shown in FIG. 2, is formed of a high-level signal, a low-level signal and an off-signal. The off-signal has the potential equal to the ground potential (0 V) of the body 7. The high-level signal and the low-level signal have higher potentials than the off-signal. The signal output line 9 is formed of a set of wiring harness.

The drive controller 6 is formed of an input discriminating circuit 10, a drive circuit 11 and an FET 12. The input discriminating circuit 10 discriminates the control signal from the computer 5 through the signal output line 9. The drive circuit 11 produces a signal according to the result of the discrimination from the input discriminating circuit 10 and supplies it to the gate of the FET 12. The FET 12 is a semiconductor device, or for example, a double-diffusion type field-effect transistor of N-type channel used in the invention. This FET 12 has a drain connected to the wiring conductor 13 of the power supply line 8 on the battery-2 side, a source connected to a wiring conductor 14 of the power supply line 8 on the fuel pump-4 side, and a gate connected to the drive circuit 11. The input signal to the gate of the FET controls the drain-source voltage.

Therefore, the drive controller 6, when supplied with the off-signal from the computer 5, controls the terminal voltage of the fuel pump 4 to be switched to 0 V. When supplied with the low-level signal from the computer 5, the drive controller 6 controls the terminal voltage of the fuel pump 4 to be switched to $\alpha$ V. When supplied with the high-level signal from the computer 5, the drive controller 6 controls the terminal voltage of the fuel pump 4 to be switched to $\beta$ V. These terminal voltages have the relation of $0\ V < \alpha\ V < \beta\ V$.

Thus, the drive controller 6 has the power switching function to switch the terminal voltages of the fuel pump 4 and the pump stop function to stop the current to the fuel pump 4 in response to the off-signal.

FIG. 3 is a flowchart showing the operation of the computer 5.

First, the ignition switch is decided to be on or not (step S1). If it is off (No), the off-signal is transmitted to the signal output line 9 (step S2), the flag is turned on (step S3) and the program is returned.

If at step S1 the ignition switch is on (Yes), it is decided the starter is operating or not (step S4). If the starter is decided to be operating (Yes), the flag F is turned to 1 (step S5), the high-level signal corresponding to the engine start is transmitted to the signal output line 9 (step S6), and the program is returned.

If at step S4 the starter is decided to be after operation (No), it is decided the flag is 1 (F=1) or not (step 7). If the flag is not 1 (No), the control of step S2 is performed.

If at step S7 the flag is decided to be 1 (Yes), it is decided the engine speed (NE) is larger than a predetermined set value (NS: for example, 100 rpm) (NE>NS) or not (step S8). If the engine speed NE is decided not to be larger than the set value NS (No), the control of step S2 is performed.

If NE is larger than NS (Yes), the low-level signal corresponding to the normal rotation of the engine is transmitted to the signal output line 9 (step S9) and the program is returned.

The action of this fuel-pump control apparatus 1 for automobile will be described with reference to FIG. 1 and 2. If the ignition switch is turned on, the main relay switch 3 is closed. In addition, when the starter is operated to rotate the engine, the computer 5 transmits the high-level signal to the signal output line 9. Thus, since the high-level signal is supplied to the input discriminating circuit 10 of the drive controller 6, the drive circuit 11 supplies a signal according to the high-level signal to the gate of the FET 12. Therefore, the FET 12 permits the battery 2 and the fuel pump 4 to be connected, so that power is supplied through the power supply line 8 to the fuel pump 4, increasing the terminal voltage to $\beta$ V. The fuel pump 4 is thus rotated at a high speed to send a large amount of fuel with a pressure to the engine.

After the engine starts, the starter stops. If at this time the engine speed is larger than a predetermined value (for example, 100 rpm), the computer 5 transmits the low-level signal to the signal output line 9. Thus, since the low-level signal is supplied to the drive controller 6, the terminal voltage of the fuel pump 4 is switched to α V. In this way, the fuel pump 4 rotates at a low speed, feeding a proper amount of fuel with a pressure to the engine.

If the engine stalls because of misoperation or an accident during the driving of the automobile, the computer 5 transmits the off-signal equal to the earth potential of the body 7 to the signal output line 9. Thus, since the off-signal is supplied to the input discriminating circuit 10 of the drive controller 6, the drive circuit 11 supplies a voltage (=0 V) corresponding to the off-signal to the gate of the FET 12. Therefore, the FET 12 permits the battery 2 and the fuel pump 4 to be disconnected, switching the terminal voltage of the fuel pump 4 to 0 V. The fuel pump 4 thus stops its rotation not to send fuel with a pressure to the engine.

Even if the battery-2 side wiring conductor 13 of the power supply line 8 touches the body 7 or bitten thereinto to be grounded, the fuel pump 4 is not powered and thus stopped irrespective of the output from the computer 5. In addition, even if the signal output line 9 is similarly grounded so that the ground potential is supplied to the drive controller 6, the FET 12 is sure to be turned off, making it possible to stop the fuel pump since the off-signal to the fuel pump 4 is equal to the potential of the body 7, or to the ground potential. Therefore, the fuel-pump control apparatus 1 for automobiles is excellent in the safety and reliability.

The fuel-pump control apparatus 1 for automobiles has the power switching function to control the fuel flow to the engine by switching the terminal voltages of the fuel pump 4, and the pump stop function to surely stop the fuel supply at the time of engine stop. Since these power switching function and pump stop function can be controlled by the single drive controller 6 through a single signal output line 9 (a set of wiring harness), the fuel-pump control apparatus can be simplified in construction.

Accordingly, it is not necessary to connect the computer to the two circuits respectively having the power switching function and the pump stop function by two signal output lines as in the prior art. Thus, since the number of parts is decreased, the cost can be reduced. In addition, since the number of assembling processes can be greatly reduced and the relay is removed, there is no noisy operation sound from the relay, and the installation freedom of the apparatus can be increased.

Another embodiment of the invention will be described with reference to FIGS. 4 to 9.

In this embodiment, the drive controller 6 used in the first embodiment is further provided with the diagnosis function by which the drive controller 6 itself can be protected from the abnormal condition of the fuel pump system and by which the computer 5 can be informed of the abnormal condition.

Figure 4:
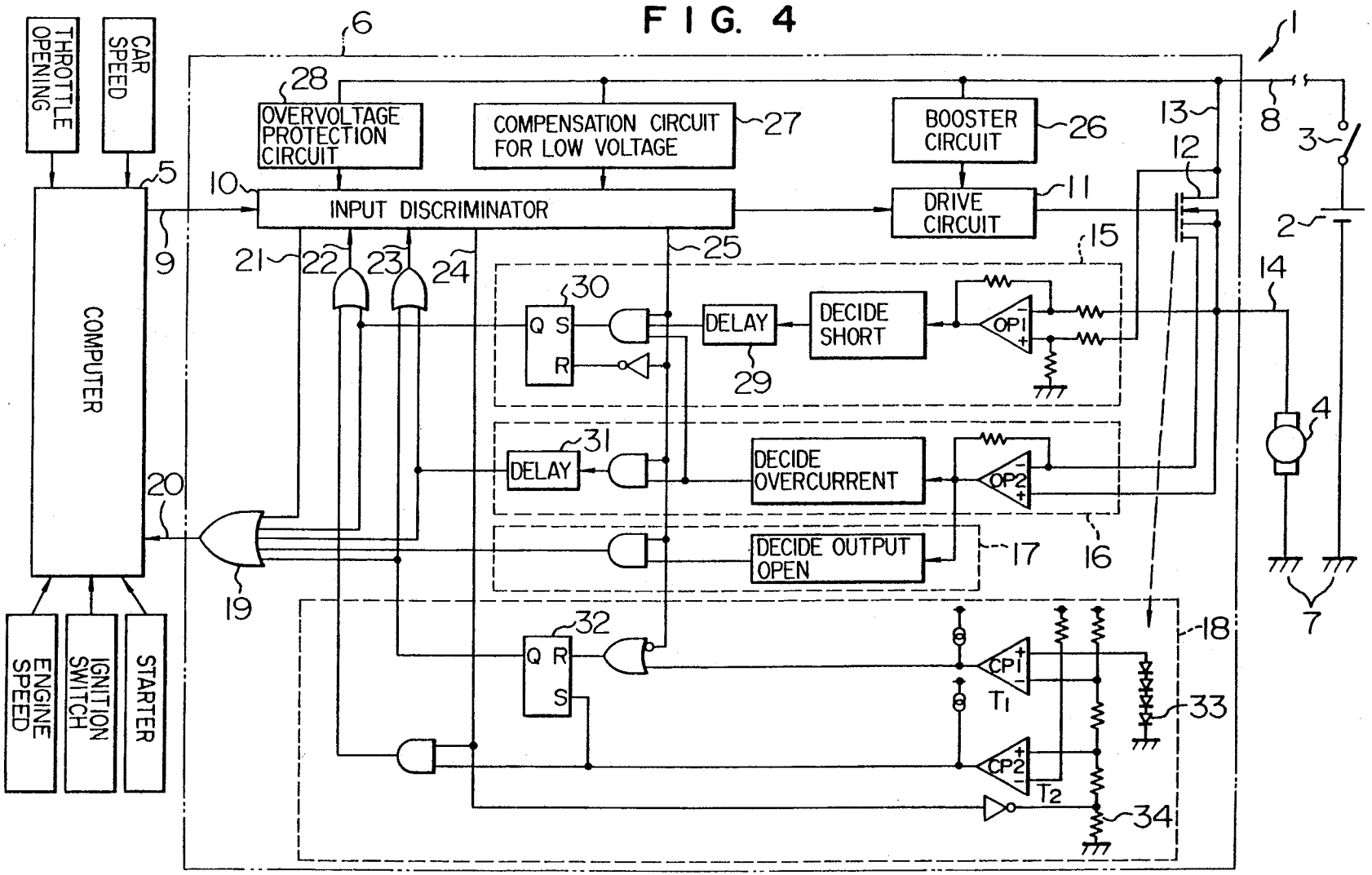
FIG. 4 is a circuit diagram of a second embodiment of the invention.

The drive controller 6 in this embodiment, as shown in FIG. 4, has a load short-circuit detecting circuit 15, an overcurrent detecting circuit 16, an open detecting circuit 17, a temperature detecting circuit 18 and a diagnosis output circuit 19 in addition to the input discriminating circuit 10 and the drive circuit 11.

The drive controller 6 further includes a voltage-boosting circuit 26 for boosting the voltage of the battery 2 and supplying it to the drive circuit 11, a low voltage compensating circuit 27 for preventing the drive controller 6 from malfunction when the battery 2 provides a low voltage, and a overvoltage protecting circuit 28 for protecting the drive controller from overvoltage.

The input discriminating circuit 10 has a signal line 21 through which a disconnecting signal is supplied, when the disconnection of an input signal line 9 is detected, input signal lines 22, 23 through which operation modes are selected according to the abnormal condition which the abnormal condition detecting circuit detects, an output line 24 through which a signal indicative of the level of the control signal from the computer 5 is produced, and an output line 25 through which a high voltage signal is produced when the pump 4 is operating. This input discriminating circuit 10 also includes circuits for making processes according to the input signals.

Figure 5A:
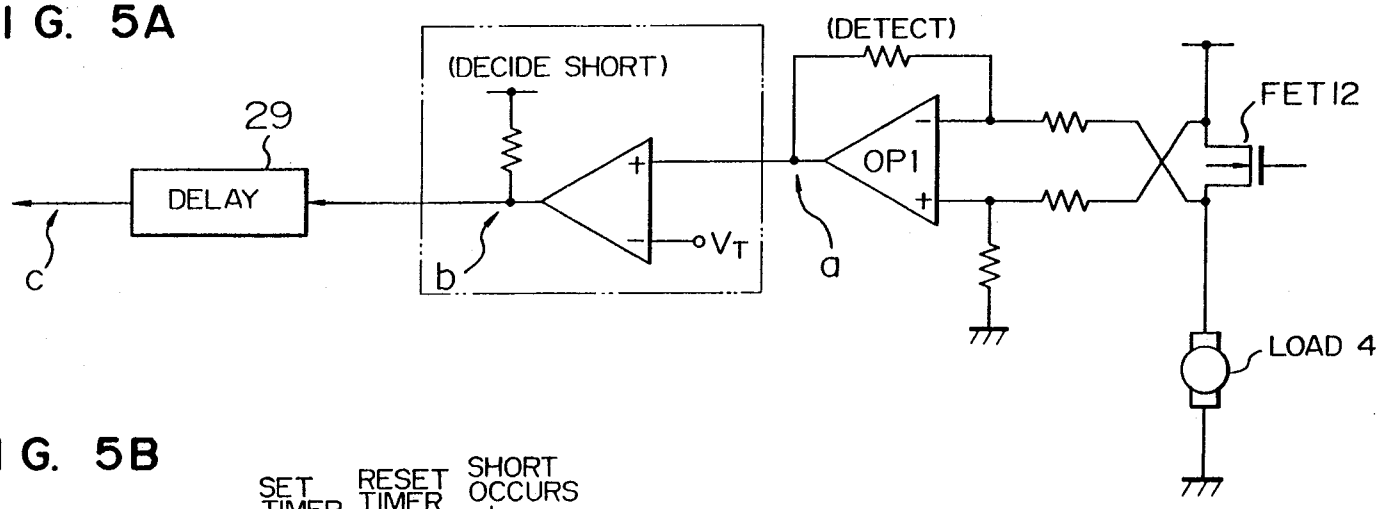
FIG. 5A is a circuit diagram of the short-circuit detecting circuit used in the second embodiment.

The load short-circuit detecting circuit 15 detects the internal short circuit of the load 4 or the short circuit between the wiring conductor 14 and the body 7. A differential amplifier OP1 detects the potential difference between the drain and the source of the FET 12, and a short discriminating circuit discriminates a short circuit. A delay circuit 29 after the short discriminating circuit confirms the short circuit, and logic circuits including an AND circuit, an inverter and a flip-flop 30 arranged in down stream of the delay circuit 29 discriminate the satisfaction of other conditions for confirming the short circuit, and supply the outputs to the input discriminating circuit 10 and the diagnosis output circuit 19. The short circuit detection is carried out by use of the fact that the drain-source voltage of the FET 12 in the on-state, or the on-voltage of the FET 12 is increased in proportion to the current flowing through the FET 12. In other words, when the load 4 is short-circuited, the potential difference between the drain and source of the FET 12 increases. As shown in FIG. 5A, the output signal a from the differential amplifier OP1 is compared with a predetermined value VT in the short discriminating circuit which is formed of an operational amplifier. The operational amplifier produces a detection output signal b.

Figure 5B:
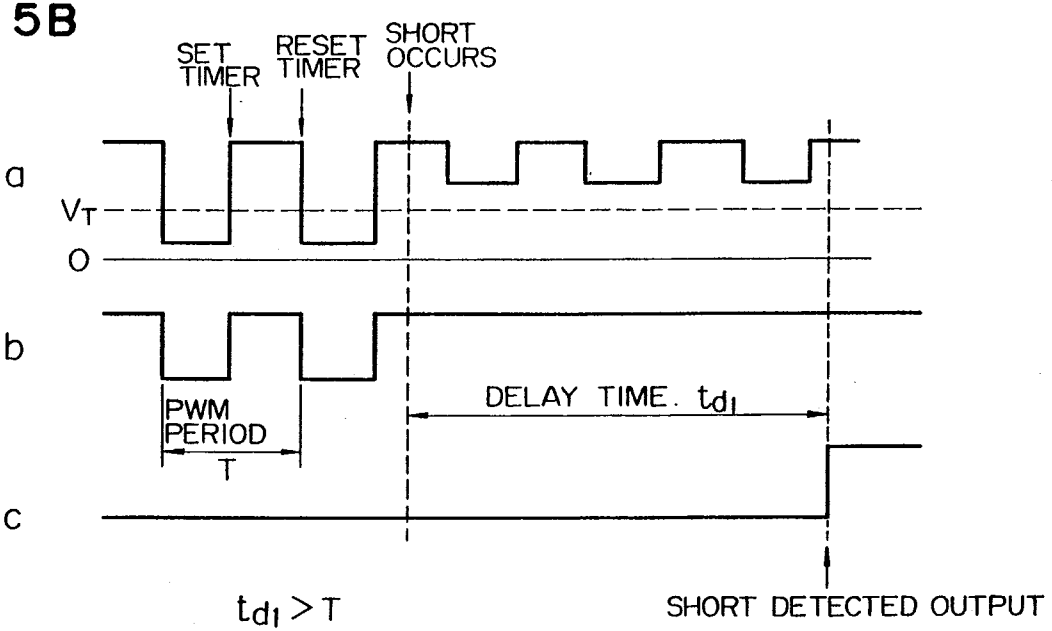
FIG. 5B is a signal-waveform diagram showing waveforms appearing when the short-circuit detecting circuit detects a short circuit.

When the FET 12 makes switching operation for duty ratio control (hereinafter, referred as PWM control), the detected voltage at the time of off signal is as high as in the short circuit, as shown as a waveform a in FIG. 5B. Thus, as shown as waveforms b and c in FIG. 5B, when the potential of the waveform a continuously exceeds the voltage $V_T$ during a certain period tdl which is longer than the PWM control period T, this abnormal state is decided to be a short circuit by the delay circuit 29.

Figure 6:
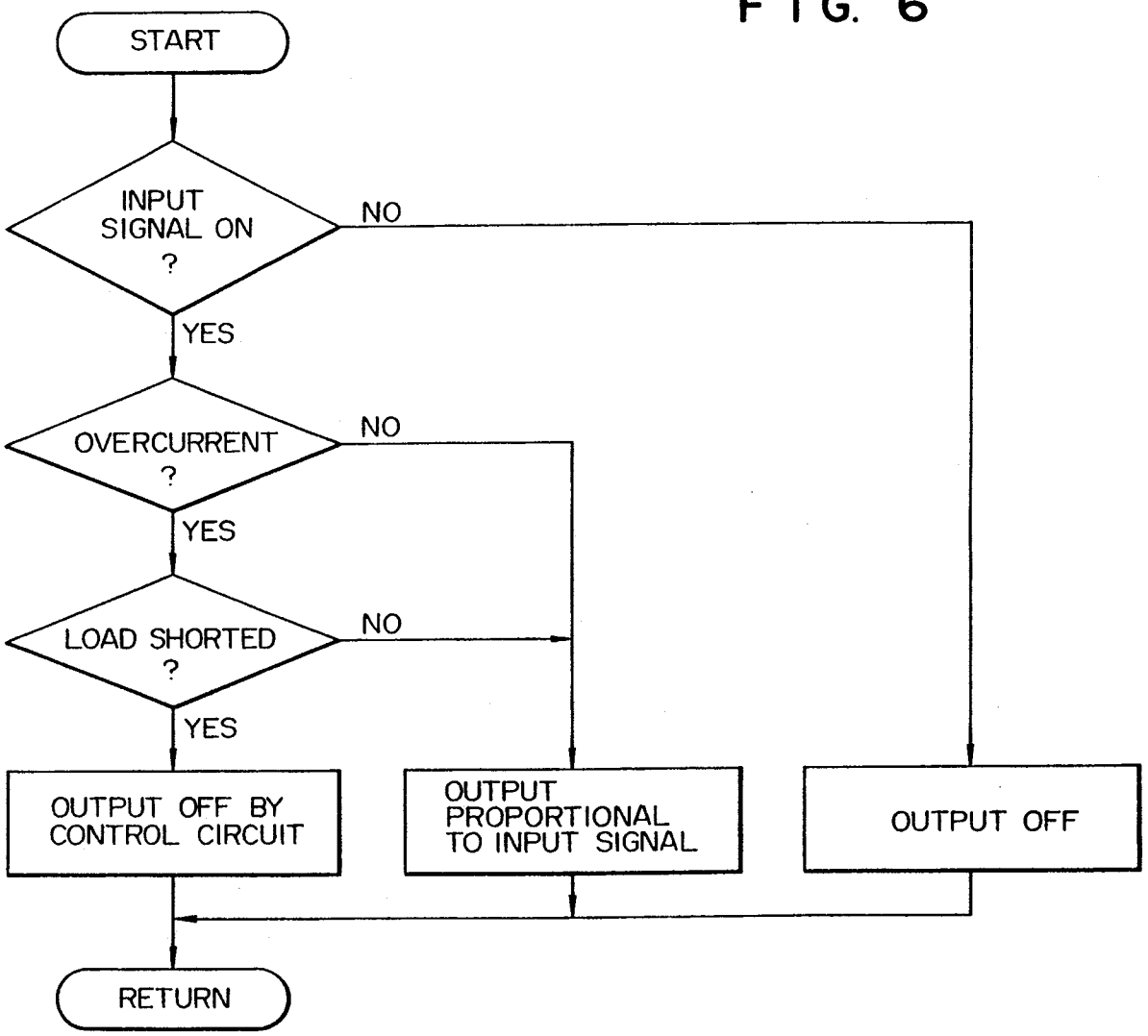
FIG. 6 is a flowchart for deciding the short circuit detection by the control circuit.

For the short circuit of the load, since the same signal is generated even when the FET 12 is off according to the on-voltage detection, such conditions as shown in FIG. 6 are confirmed. In other words, first the input signal to the drive controller 6 is tested if it is the pump operation mode. This is decided from a signal in the output line 25 from the input discriminating circuit 10 being in the high level as shown in FIG. 4. Second, the current flowing in the FET 12 is tested if it is overcurrent. This is decided by the output of the overcurrent detecting circuit 16 which will be described later.

When the short circuit of the load is decided being satisfied with the above two conditions, the decision signal is supplied through the signal line 22 to the input discriminating circuit 10, and the input discriminating circuit 10 produces a forcible-off signal for turning the FET 12 off. This state is maintained by the flip-flop 30 until the input signal is turned off or the ignition switch 3 is turned off so that the voltage of the battery 2 is not supplied to the drive controller 6. This state is released by change of the output signal in the line 25.

The overcurrent detecting circuit 16 measures the current flowing in the FET 12 by the current mirror using a part of the cells of the FET 12, and monitors the abnormal condition of the load 4. When the fuel pump 4 is locked or half-locked (not completely stopped, but rotates slowly or is likely to stop), or when pipes connected with the pump are clogged so that the fuel pressure is abnormally high, the current to the pump is increased. Thus, the abnormal condition of the pump can be detected by monitoring the overcurrent in the FET 12. The overcurrent detecting circuit 16 has an operational amplifier OP2 for amplifying the voltage indicative of the current in the FET 12, and an overcurrent discriminating circuit, an AND circuit for the logical sum of the signal supplied through the signal line 25 upon operation of the pump and the output signal from the overcurrent discriminating circuit, and a delay circuit 31 for distinguishing the rush current upon start of the pump from others. The delay time of the delay circuit 31 is selected to be longer than the delay time t dl for short-circuit detection.

When an overcurrent is detected, the FET 12 is not forcibly turned off as in the short-circuit detection, but a forcible H-mode signal is supplied through the signal line 23 to the input discriminating circuit 10 so that the FET 12 is made fully turned on (called the H-mode). Thus, the fuel pump 4 achieves the maximum torque for the maximum fuel flow which acts to remove the clogging and catching within the pump or the clogging in the piping due to the locking or half-locking of the pump. When the current flowing in the FET 12 is returned to the normal value after it is made in the H-mode, the drive controller 6 again normally operates in accordance with the input signal. The output from the overcurrent detecting circuit 16 is supplied through the diagnosis output circuit 19 to the computer 5, and used for the control of the drive controller and so on.

Figure 7:
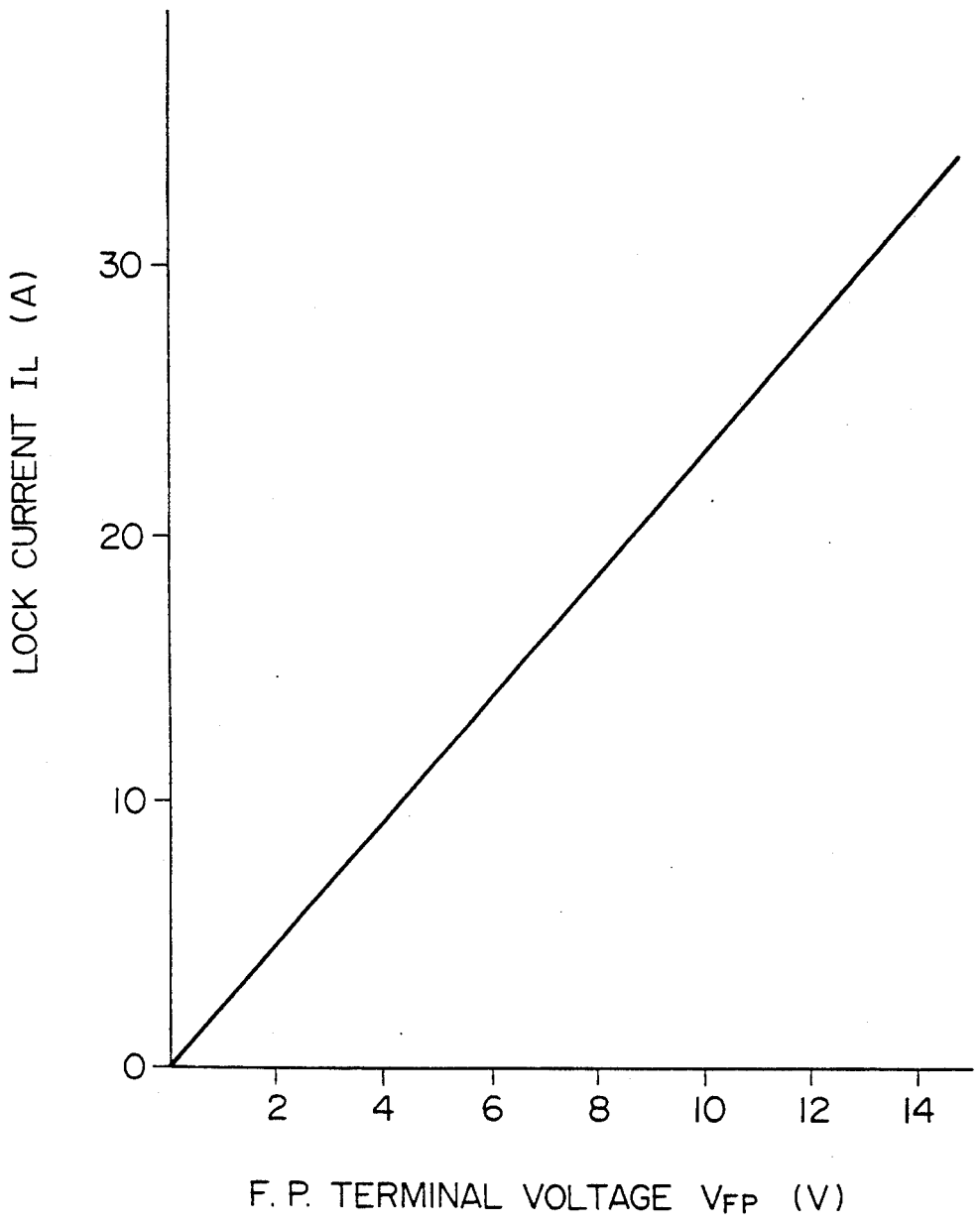
FIG. 7 is a graph showing the relation between the current and the terminal voltage when the fuel pump is locked.

Now, let it be considered how the set value of current for detection by the short-circuit detecting circuit 15 is related to that by the overcurrent detecting circuit 16. For example, the current to the fuel pump used in a small car, when it is locked, is 30 to 35 A maximum from the battery 2 of 12 V as shown in FIG. 7. Thus, the set voltage for detecting short-circuit current is preferably set about 40 A being higher than the above described 30 to 35 A flowing through the pump in a completely locked state. The overcurrent to be detected should be empirically set to be about 10 to 20 A higher than the current flowing the pump in an abnormal state because the voltage to the pump depends on the operation mode. In that case, the delay circuit 31 is set to the delay time of about 100 mS.

The open detecting circuit 17 for detecting the open circuit accident in the output line 14 monitors the current through the FET 12 using the circuit for detecting the FET current in the overcurrent detecting circuit 16 and detects the state that the current stops. Of course, the input signal on the signal line 25 is required to be the operation mode. The detection outputs are supplied through the diagnosis output circuit 19 to the computer 5.

The temperature detecting circuit 18 has a temperature detecting diode 33 of which the forward voltage has a temperature dependence characteristic. Thus, the temperature increase due to the heat generation in the FET 12 is detected by this diode. The temperature detected output from the diode is supplied to two comparators CP1 and CP2 and it is compared with threshold values T1 and T2 ($T1<T2$) respectively. The threshold values T1 and T2 are changed to $T1'(>T1)$ and $T2'(>T2)$ in the H-mode by the output 24 from the input discriminating circuit 10 and a resistor 34. At the normal operating temperature, or below T1, the flip-flop 32 is always in reset state.

Figure 8:
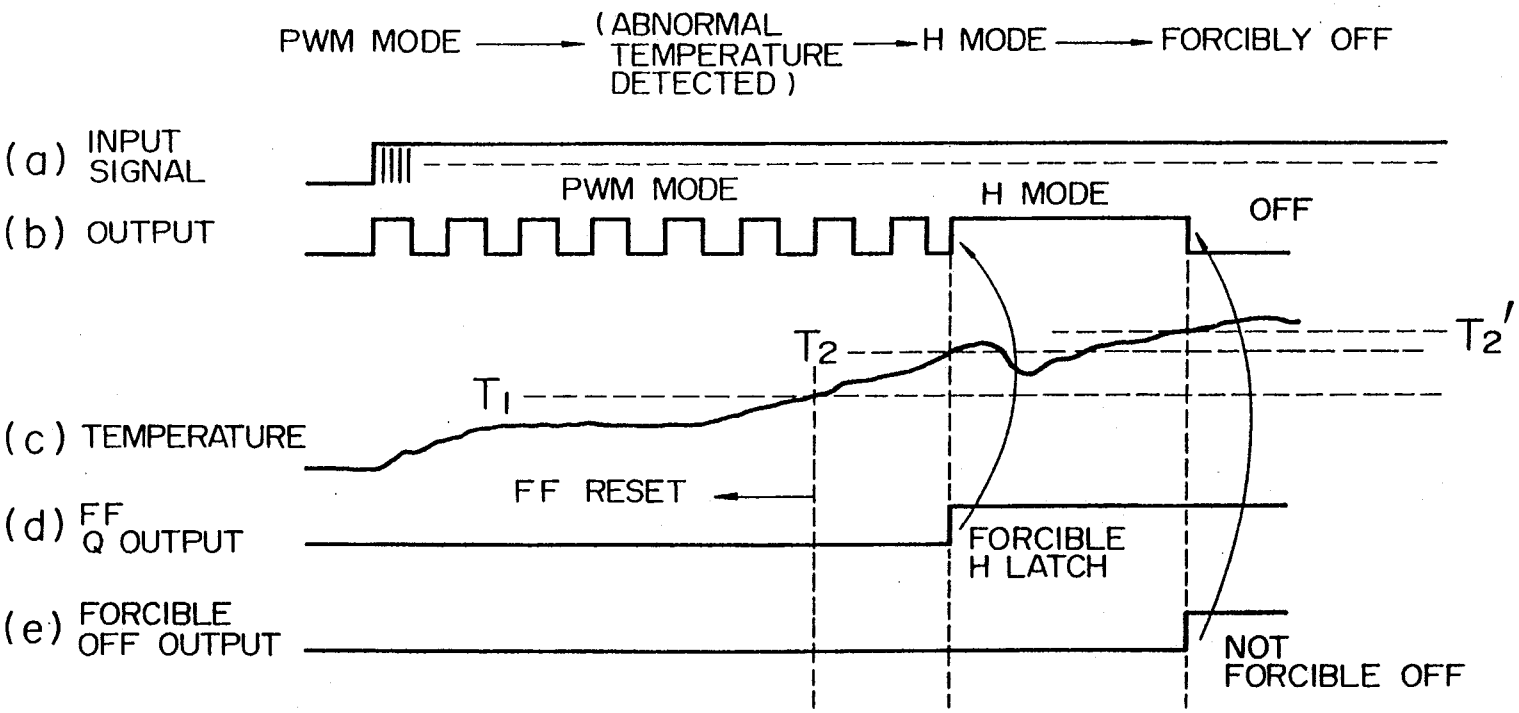
FIG. 8 is a signal-waveform diagram of certain signals in case the control apparatus stops the pump when the pump is forcibly driven but the temperature rises.

FIG. 8 is a signal waveform diagram of signals showing that the pump is controlled by the temperature detecting circuit 18. When the input signal becomes the operation mode and when the temperature of the FET is increased to exceed the threshold value T1, the flip-flop 32 is made in the stand-by state. When the temperature exceeds the threshold value T2, it is supplied with an input signal from the comparator CP2 and the output is supplied through the signal line 23, changing the operation mode into the forcible H-mode so that the fuel pump 4 is fully rotated. This condition is maintained by the flip-flop 32.

The temperature increase due to the heat generation in the FET 12 is probably attributed first to a locked state or half-locked state of the fuel pump 4 as well as an overcurrent through the FET 12. In this case, the forcible H-mode is effective as described abode. The second source for the temperature increase may be considered to be a deterioration of the boosting circuit 26 in FIG. 4. The forcible H-mode is also effective in the second case, since the boosted voltage from the boosting circuit is applied to a driver for the gate of the FET 12, the consumption current is smaller in the H-mode than in the PWM mode in which the switching is made, and a required capacity of the boosting circuit 26 may be smaller. Thus, the boosted voltage can be prevented from being reduced in the forcible H-mode. An N-channel power MOS FET having a low on-voltage is used for the FET 12. Since the FET 12 intrinsically has a small DC loss and a larger switching loss than the DC loss, the FET 12 is operated to reduce the heat generation in the forcible H-mode rather than in the switching mode.

Figure 9:
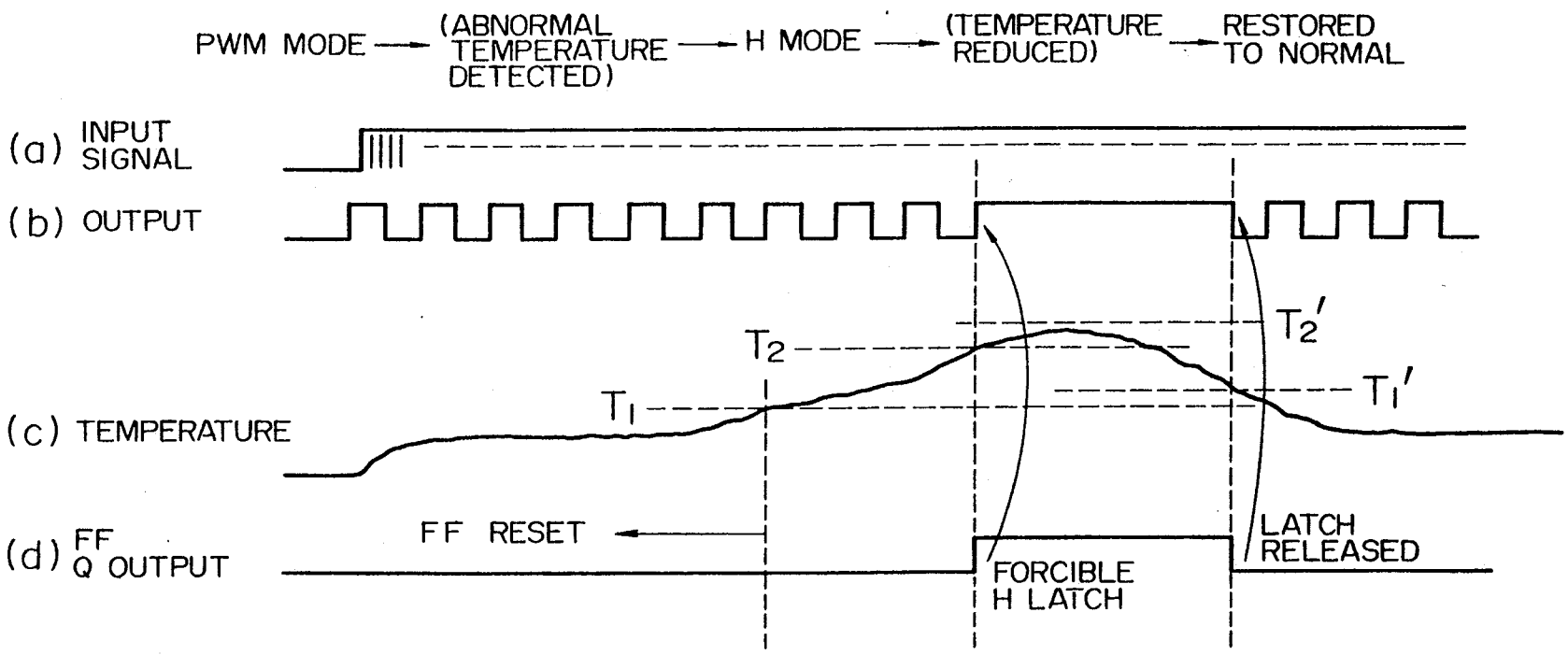
FIG. 9 is a signal-waveform diagram showing that the pump is forcibly driven to be restored to the normal state.
Figure 10:
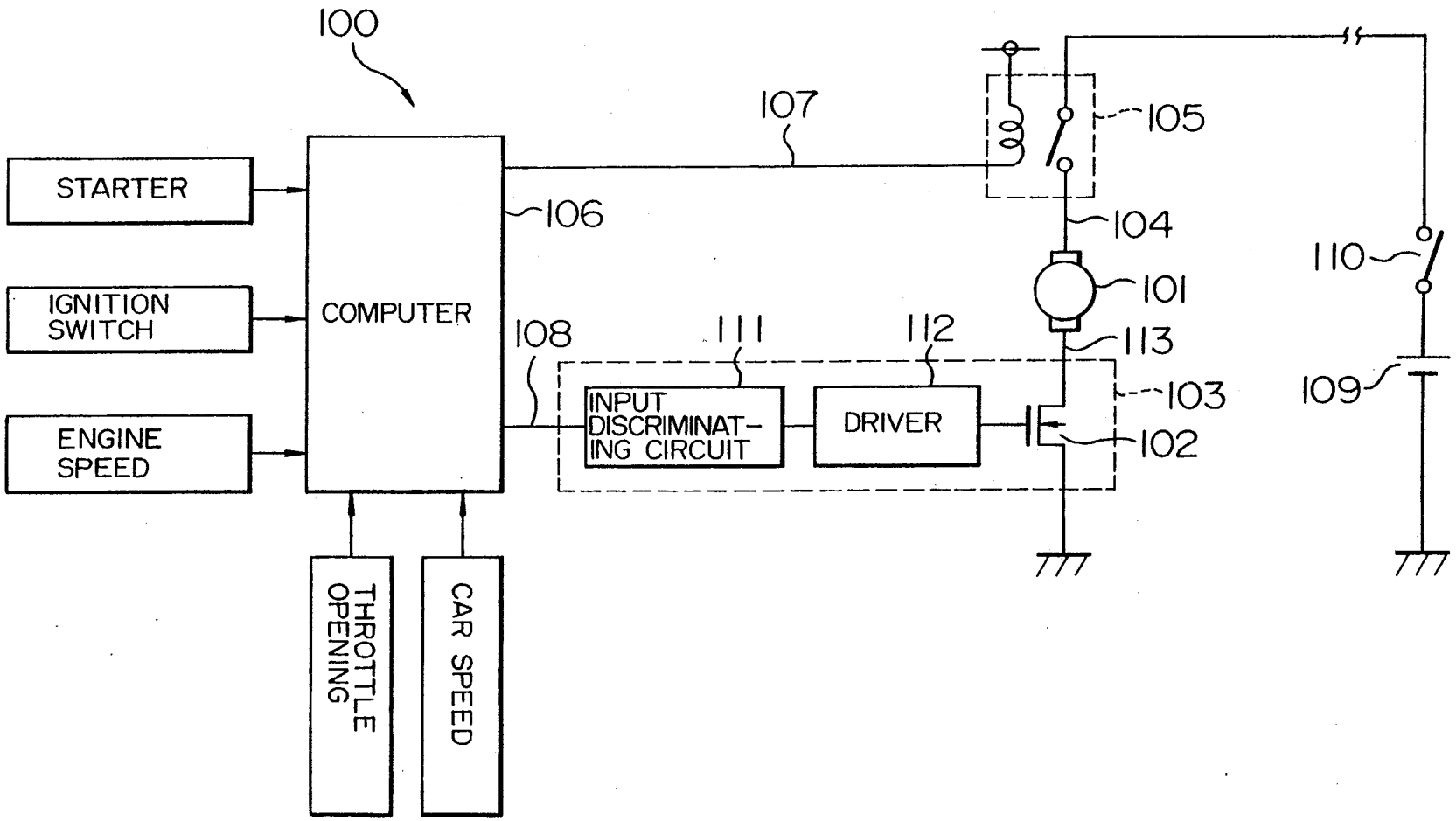
FIG. 10 PRIOR ART
FIG. 10 is a schematic wiring diagram of a conventional fuel-pump control apparatus.

As shown a temperature change (C) in FIG. 8, when the temperature is further increased to T2' even after turning to the forcible H-mode after detecting an abnormal temperature, the drive controller 6 is forcibly turned off through the signal line 22. In this case, however, the forcible off-signal is not latched. Then, if the temperature is decreased to be lower than T2' afterward, the drive controller 6 is again started unless the engine is stopped. As shown in FIG. 9, if the temperature is reduced under T1' by the above effect and other effects after the drive controller is made in the forcible H-mode, the flip-flop 32 is reset so that the normal operation is again carried out. The value of T2' is selected to be about 150° C. for the protection of the semiconductor devices from high temperatures.

A diagnosis output circuit 19 informs the computer 5 of all the abnormal modes described above through the signal line 20. The diagnosis signal, which is provided to the signal line 21 as a result of detecting disconnection of the input line 9, is also produced when the input signal is off. Thus, it is supplied to the computer 5 for determinating an exact meaning of the signal in conjunction with other conditions.

A low-voltage compensation circuit 27 is provided to cancel all the abnormal-condition detecting functions described above and preferentially drive the fuel pump 4, when the fuel pump 4 and the drive controller 6 become unstable in operation because of an abnormally low voltage of the battery 2 in an on-operation of the starter at starting the engine.

While in the embodiments, an N-channel double diffusion type field-effect transistor is used as the semiconductor device for controlling the current to the fuel pump, an NPN transistor, a PNP transistor or a thyristor may be used for the same purpose.

While the drive signal (the high-level signal and the low-level signal) has a higher potential than the stop signal (the off-signal) in the embodiments, the drive signal may have a lower potential than the stop signal.

Moreover, the drive signal on the signal output line may be a pulse signal type different from the potential switching type.

The terminal voltage of the fuel pump may be controlled by only on-off operation of the semiconductor device or by a duty ratio control of the on-off time. The steps of the power-switching function may be more than three and the function may have no steps, namely be a linear control.

The signal output line may be not only one set of wiring harness for serial communication, but also a plurality of sets of wiring harness for parallel signal processing. In addition, when the power switching function needs complicated control, a plurality of sets of wiring harness may be used for each serial communication.

The short-circuit detecting circuit 15 and the overcurrent detecting circuit 16 may measure either the on-voltage of the FET 12 or the current by the current mirror using a part of the cells in the FET 12. Also, the detecting circuits 15 and 16 may use any sensor like a pickup coil or the like which can produce a voltage output proportional to the current flowing in the FET 12.

While the open state is decided by the current detection, it may be decided by an output voltage measurement.

Moreover, while the temperature, or the heat generation of the FET 12 is measured by the temperature dependence characteristic of the forward voltage of the diode 33, it may be replaced by a thermistor or the like which produces a voltage change proportional to the temperature change.

In addition, a hysteresis effects made by the use of the threshold values of the two comparators CP1 and CP2 may be replaced by a delay time of the temperature detection for the forcible H-mode. The forcible H-mode after temperature detection may be replaced by a lower-temperature mode in the same system. The condition decided that the input signal is the operating mode may be used for deciding any abnormal condition selectively. The decision of the input signal indicating the operation mode or the information of the input signal may be supplied from the drive circuit 11 for the FET 12, not from the input discriminating circuit 10.

On the contrary, the information of the forcible H-mode and a forcible off-signal may also be supplied to the drive circuit 11, not to the input discriminating circuit 10.

Moreover, in order to eliminate discrimination errors, the logical decision may be made only after twice or more of the read-out operations. Particularly, the diagnosis output circuit 19 may repeatedly read each abnormal mode twice or more in order to prevent from diagnosis errors.

A delay introduced in each discrimination operation may reduce effect by noise or the like to eliminate discrimination errors.

According to this invention, in an occurrence that the power supply line or the signal output line is brought to the same potential as the body of the vehicle, the fuel pump surely stops, and the fuel-pump control apparatus can be miniaturized and get quiet, and the signal output lines can be simplified.

We claim:

1. A fuel-pump control apparatus to be installed in a vehicle having a body, comprising:

a battery having a first electrode connected to said body and a second electrode for supplying power;

a fuel pump receiving said power from said second electrode;

a computer, having a signal output line, operating to selectively produce either one of a stop signal of a potential equal to that of said body and a drive signal of a potential equal to that of said body and a drive signal of a different potential from said stop signal on said output line; and a semiconductor device having a first power terminal connected to said second electrode through a first conductor, a second power terminal connected to said fuel pump through a second conductor, and a control terminal connected to said signal output line, said semiconductor device being turned on to supply power through said first and second power terminals when said drive signal is received through said control terminal, being turned off to interrupt said power supply when said stop signal is received through said control terminal and being turned off when at least one of said second conductor and said signal output line of said computer has a potential substantially equal to that of said body.

2. A fuel-pump control apparatus according to claim 1, further comprising a short-circuit detecting circuit for detecting a short circuit of a load of said semiconductor device and providing a signal for turning off said semiconductor device.

3. A fuel-pump control apparatus to be installed in a vehicle having a body, comprising:

a battery having a first electrode connected to said body and a second electrode for supplying power;

a fuel pump receiving said power from said second electrode;

a computer having a signal output line and for selectively providing on said signal output line either one of a stop signal of a potential equal to that of said body and a drive signal of a different potential from said stop signal;

a semiconductor device having a first power terminal connected to said second electrode through a first conductor, a second power terminal connected to said fuel pump through a second conductor, and a control terminal connected to said signal output line, said semiconductor device being turned on to supply power through said first and second power terminals when said drive signal is received through said control terminal, and turned off to interrupt said power supply when said stop signal is received through said control terminal; and a short-circuit detecting circuit for detecting a short circuit of a load of said semiconductor device and providing a signal for turning off said semiconductor device, wherein said short-circuit detecting circuit detects a current flowing in said semiconductor device, and determines that there is a short circuit when said current is larger than a lock state current which flows in said semiconductor device while said fuel pump is in a completely locked state, and said fuel-pump control apparatus further comprises an overcurrent detecting circuit having a set value which is lower than said lock state current for detecting said current flowing in said semiconductor device and providing a signal for making said semiconductor device substantially conductive when said current in said semiconductor device reaches said set value.

4. A fuel-pump control apparatus to be installed in a vehicle having a body, comprising:

a battery having a first electrode connected to said body and a second electrode for supplying power;

a fuel pump receiving said power from said second electrode;

a computer having a signal output line and for selectively providing on said signal output line either one of a stop signal of a potential equal to that of said body and a drive signal of a different potential from said stop signal;

a semiconductor device having a first power terminal connected to said second electrode through a first conductor, a second power terminal connected to said fuel pump through a second conductor, and a control terminal connected to said signal output line, said semiconductor device being turned on to supply power through said first and second power terminals when said drive signal is received through said control terminal, and turned off to interrupt said power supply when said stop signal is received through said control terminal; and a temperature detecting circuit, having a first set value and a second set value which is larger than said first set value, for detecting a temperature of said semiconductor device, providing a signal for making said semiconductor device substantially conductive when said temperature exceeds said first set value, and providing a stop signal to said semiconductor device when said temperature exceeds said second set value.

5. A fuel-pump control apparatus to be installed in a vehicle having a body, comprising:

a battery having a first electrode connected to said body and a second electrode for supplying power;

a fuel pump receiving said power from said second electrode;

a computer having a signal output line and for selectively providing on said signal output line either one of a stop signal of a potential equal to that of said body and a drive signal of a different potential from said stop signal;

a semiconductor device having a first power terminal connected to said second electrode through a first conductor, a second power terminal connected to said fuel pump through a second conductor, and a control terminal connected to said signal output line, said semiconductor device being turned on to supply power through said first and second power terminals when said drive signal is received through said control terminal, and turned off to interrupt said power supply when said stop signal is received through said control terminal;

a short-circuit detecting circuit for detecting a short circuit of a load of said semiconductor device and providing a signal for turning off said semiconductor device; and a temperature detecting circuit, having a first set value and a second set value which is larger than said first set value, for detecting a temperature of said semiconductor device, providing a signal for making said semiconductor device substantially conductive when said temperature exceeds said first set value, and providing a stop signal to said semiconductor device when said temperature exceeds said second set value.

6. A load control apparatus for controlling a DC power supply to supply power to a load, comprising:

a semiconductor device connected between said DC power supply and said load so as to intermittently control said DC power supply to supply power to said load;

an overcurrent detecting circuit, having a set value which is lower than a first value of a current flowing through the device when said load is short-circuited, for detecting a current flowing in said semiconductor device, and supplying to said semiconductor device a signal for making said semiconductor device substantially conductive when said current reaches said first set value;

a short-circuit detecting circuit for supplying a stop signal to said semiconductor device so as to turn the same off when said overcurrent detecting circuit detects an overcurrent and detects that said load of said semiconductor device is short-circuited; and a temperature detecting circuit, having a second set value and a third set value higher than said second set value, for detecting a temperature of said semiconductor device, supplying to said semiconductor device a signal for making said semiconductor device substantially conductive when said temperature exceeds said second set value, and supplying to said semiconductor device a stop signal when said temperature exceeds said third set value.

* * * * *